US007101325B2

(12) United States Patent
Rigouby

(10) Patent No.: US 7,101,325 B2
(45) Date of Patent: Sep. 5, 2006

(54) EXERCISE APPARATUS AND PROCESS OF MANUFACTURE THEREFORE

(76) Inventor: Diana Rigouby, 7612 Hgny 71 W, Suite F, Austin, TX (US) 78735

( * ) Notice: Subject to any disclaimer, the term of this patent is extended or adjusted under 35 U.S.C. 154(b) by 313 days.

(21) Appl. No.: 10/126,305

(22) Filed: Apr. 20, 2002

(65) Prior Publication Data

US 2003/0199371 A1 Oct. 23, 2003

(51) Int. Cl.
*A63B 21/02* (2006.01)

(52) U.S. Cl. ..... 482/126; 482/148; 482/907

(58) Field of Classification Search ..... 482/126–130, 482/907, 23, 24, 121–125, 141, 91, 148, 482/62

See application file for complete search history.

(56) References Cited

U.S. PATENT DOCUMENTS

| | | | | |
|---|---|---|---|---|
| 4,033,580 | A * | 7/1977 | Paris | 272/137 |
| 5,205,803 | A * | 4/1993 | Zemitis | 482/121 |
| 5,555,564 | A * | 9/1996 | Welch | 2/239 |
| 6,227,742 | B1 * | 5/2001 | Corn et al. | 401/201 |
| 2002/0055424 | A1 * | 5/2002 | Brown | 482/91 |

* cited by examiner

*Primary Examiner*—Lori Amerson
(74) *Attorney, Agent, or Firm*—Geoffrey A. Mantooth

(57) ABSTRACT

An exercise apparatus comprising one or more pair of grasping sections and one or more extensible sections to enable the apparatus to be stretched to an extended length from an un-extended length.

6 Claims, 5 Drawing Sheets

EXERCISE APPARATUS AND PROCESS OF MANUFACTURE THEREFORE

TECHNICAL FIELD OF THE INVENTION

The present invention relates to the field of exercise and exercise equipment, and more particularly to methods and apparatus for body-mind integration exercises.

BACKGROUND OF THE INVENTION

In the field of human exercise, techniques and exercises have been developed that integrate mental and physical processes to improve the health and fitness of both the mind and the body. Pioneered by Joseph Pilates 70 years ago, the techniques of body/mind integration that have been developed are used today by many people seeking fitness programs that offer more than conventional methods. The methods of body/mind integration exercise deep muscles within the body in a harmonic and controlled fashion to achieve efficient and graceful movement, improve posture and breathing, and increase body awareness.

One particular aspect of body/mind methodology involves what is known as "towel work," which employs a rolled towel, held at each end by the hands. The hands may then be spread apart to stretch the towel into tension, and the arms may be moved in synchronous exercises of upper body muscles. A wide range of towel exercises have been developed to provide a non-impact balanced exercise of upper body muscle groups especially around the neck and shoulders. Towel work benefits the user by enhancing depression and retraction of the shoulder girdle, opening and expanding the anterior chest and shoulder muscles, correcting forward head posture, increasing range of motion in the cervical spine and the shoulder girdle for weight bearing work on equipment. This inexpensive method provides numerous advantages and can be employed while standing, sitting or in a lying position.

There are, however, disadvantages to using a rolled towel for towel work. Different towels of different length will produce different distances between the hands holding the towel at its ends. When the hands are not held an optimal distance apart, the advantages achievable by the exercise is diminished. Further, a rolled towel will typically lack a desirable extent of extensibility, producing unnecessary muscle strain and misapplication of muscle stresses. Also, a rolled towel is difficult to hold and an undesirable degree of soreness in the hands can develop during the course of the exercise. Moreover, all towels are not of uniform weight and most are not of a desired weight.

Thus, there is a need for an invention that overcomes these and other prior art limitations.

SUMMARY OF THE INVENTION

The present invention overcomes prior art limitations by providing exercise towels and methods of their manufacture.

According to the present invention an exercise apparatus is provided that comprises at least one extensible section and a plurality of grasping sections. The apparatus provides a desired upper limit of extensibility and easy comfortable gripping for performing exercises. Further the apparatus may be made of lightweight cloth material in uniform lengths.

The foregoing has outlined rather broadly the features and technical advantages of the present invention in order that the detailed description of the invention that follows may be better understood. Additional features and advantages of the invention will be described hereinafter. It should be appreciated by those skilled in the art that the disclosure provided herein may be readily utilized as a basis for modifying or designing other structures for carrying out the same purposes of the present invention. Persons of skill in the art will realize that such equivalent constructions do not depart from the spirit and scope of the invention as set forth in the appended claims, and that not all objects attainable by the present invention need be attained in each and every embodiment that falls within the scope of the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
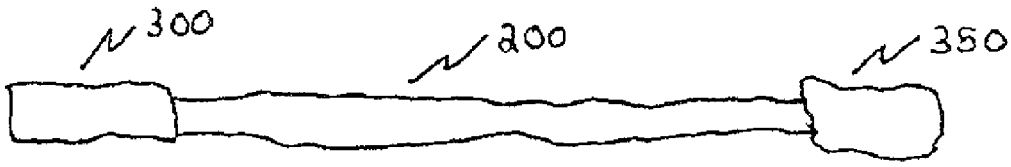
FIG. 1 is an embodiment of the present invention.

A preferred embodiment of the present invention is shown in FIG. 1. An exercise apparatus 100 is shown with a single extensible section 200 and grasping sections 300 and 350 one on each end. Apparatus 100 is preferably made of high quality Terry cloth.

Figure 2:
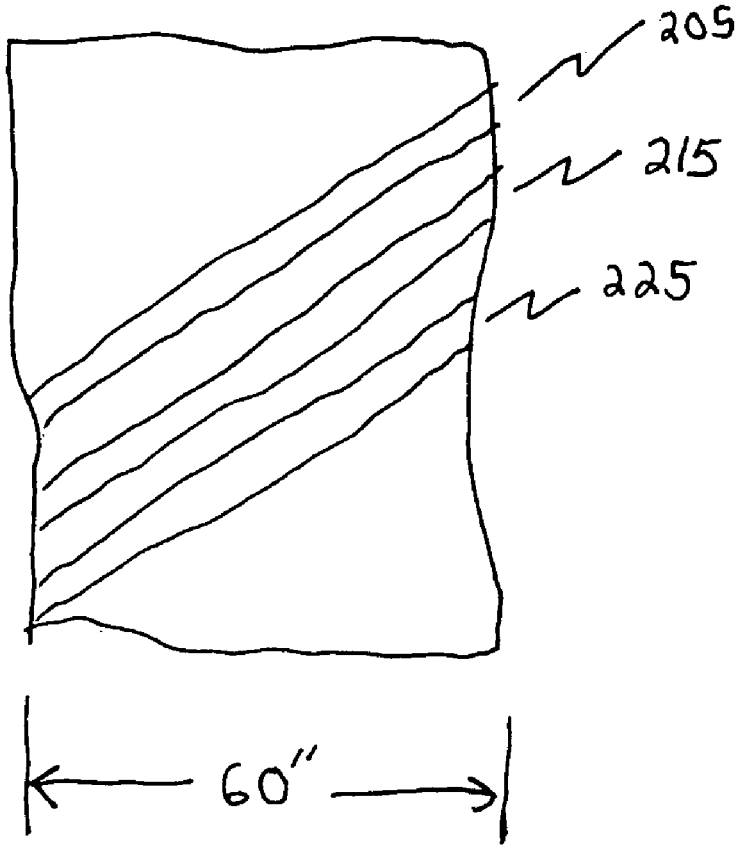
FIG. 2 is a piece of cloth for making an embodiment of the invention.
Figure 3:
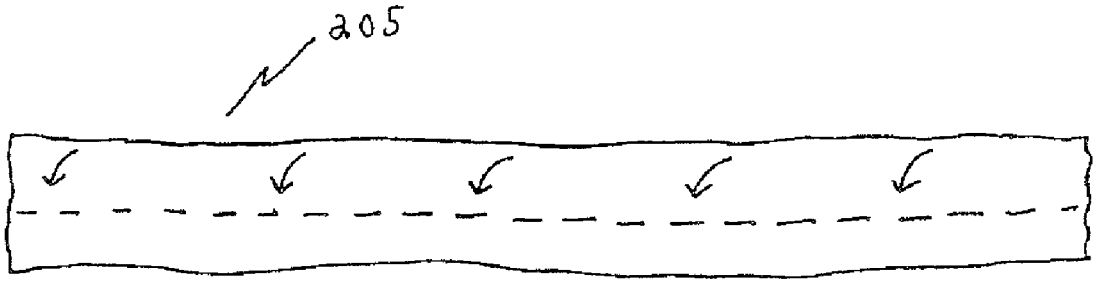
FIG. 3 is a strip of cloth for making a strand for an embodiment of the invention.
Figure 4:
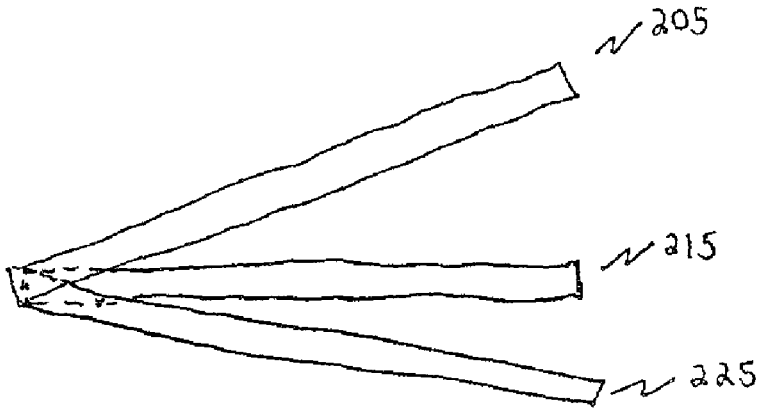
FIG. 4 is an illustration of three strands sewn together at their ends.

An embodiment of extensible section 200 comprises three braided strands. The strands forming extensible section 200 may be made according to the method illustrated in FIGS. 2 through 4. FIG. 2 shows a 60" wide bolt of high quality Terry cloth. Three strips, 205, 215, and 225, each about 3.5 inches wide and about 54" long are cut from the bolt of cloth along the bias. Each strip is folded in half along the long axis as shown in FIG. 3 for strip 205. Then, each strip is surged and sewn, parallel to the folding axis, and turned inside out. Three ends of the three strips are then sewn together as shown in FIG. 4 to form the first sewn end of the braid to be formed by the three strands. The first sewn end is anchored and the three strands are braided. The remaining three ends of the strands are now sewn together to form extensible section 200.

To form a grasping section, 300 or 350, a 4"×6" piece of high quality Terry cloth is surged and sewn, along the long axis, and turned inside out, to form a cloth cylindrical configuration that may be employed as an end piece that may be pulled over extensible section 200. A first end of the end piece is securely sewn to one end of extensible section 200. Then, the end piece is pulled over extensible section 200 and the second end of the end piece is tacked and sewn securely to extensible section 200 to form a grasping section 300 or 350. This provides a relatively comfortable means to hold both ends of apparatus 100 and reduces the potential for muscle strain in the hands.

Given the above-mentioned nominal dimensions of the three strands forming extensible section 200 and nominal dimensions of the end pieces forming grasping sections 300 and 350, the length of the segment of extensible section 200 lying between grasping sections 300 and 350 will be about 46" to 48" when extensible section 200 is extended. This will accommodate the shoulder span of at least a great many, if not most, individuals. Clearly, different shoulder spans, and indeed, different exercise objectives, may be accommodated by lengthening or shortening one or more of each section of apparatus 100 from the nominal dimensions given above.

The braided extensible section enables the apparatus to be pulled into varying degrees of tension. The material used to manufacture apparatus 100 is lightweight and preferably not antagonistic to human skin. Cloths, fabrics, and other textile manufactures that provide comfortable grasping and a desired extensibility can be used in the present invention. Moreover, any plural number of strands can be braided, interwoven, or even knotted to form extensible section 200. Also, a fabric or cloth that exhibits a desirable degree of extensibility in a single piece of suitable length may be employed as an extensible section or employed together with one or more other similar pieces of equal length that are connected in parallel but not woven or braided.

Further, two or more extensible sections may be joined at the ends by one or more connecting sections. A connecting section may be formed, for example, in a manner similar to forming a grasping section. That is, one may form a connecting section by making the cloth cylindrical configuration that is used to form the grasping section embodiment described above. Then, one end of one extensible section may be inserted into one end of a connecting section and one end of a second extensible section may be inserted into the opposite end of the connecting section. Then, each extensible section is sewn to the connecting section to connect the two extensible sections. Note also that the connecting section itself may be extensible or non-extensible. Thus, a plurality of extensible sections may be connected together in series to form the exercise apparatus of the present invention.

That apparatus of the present invention is designed to exhibit an extended length and an un-extended length. The un-extended length is the length exhibited when the apparatus is laid out fully along a straight line with no tension applied. The extended length is the length exhibited when tension is applied to extend the apparatus into full tension beyond which the apparatus can be stretched no further. For the type of exercises for which the apparatus of the present invention is designed, the difference between the extended and un-extended length is only a small percentage of the un-extended length. The apparatus is preferably designed to exhibit an extended length that is desired for a specified shoulder span for a given class of exercises. When the apparatus is extended, more than a pre-determinable maximum distance will not separate the arms and hands grasping each end.

Desirably, the strength required to extend the apparatus to its extended length is that of a person with ordinary strength. Beyond that length the apparatus can be stretched no further, even if the user possesses greater than ordinary strength. Thus, the present invention is not designed to enable a person to stretch an apparatus up to the limits of his or her strength. Rather, the present invention is designed to place desired muscles into sufficient tension to keep them engaged in the exercise. The user may vary the degree of engagement only up to the limit imposed by the extended length of the apparatus.

In a typical embodiment, the difference between the extended and un-extended length would not exceed about 20% of the un-extended length. For example, if the un-extended length is 40 inches, the extended length would not exceed about 48 inches. For most applications the extended length would not exceed about 10% of the un-extended length. Indeed, it may be preferable for a large class of exercises to limit the extensibility to less than about 5%. In fact, the apparatus of the present invention can be designed to exhibit practically no extensibility at all. For example, material can be employed so that the apparatus exhibits extensibility of less than 1%. In this case, pulling the device into tension places the device into the extended state without significant intermediate stretching. Thus, a connecting section that is practically non-extensible, with a grasping section connected to each end, may be employed as the exercise apparatus without the inclusion of a more extensible section. This non-extensible embodiment is not, however, preferred since the user cannot apply varying degrees of tension to control the extent of muscle engagement. Even so, both non-extensible and extensible embodiments can be manufactured in uniform lengths that are lightweight.

Figure 5:
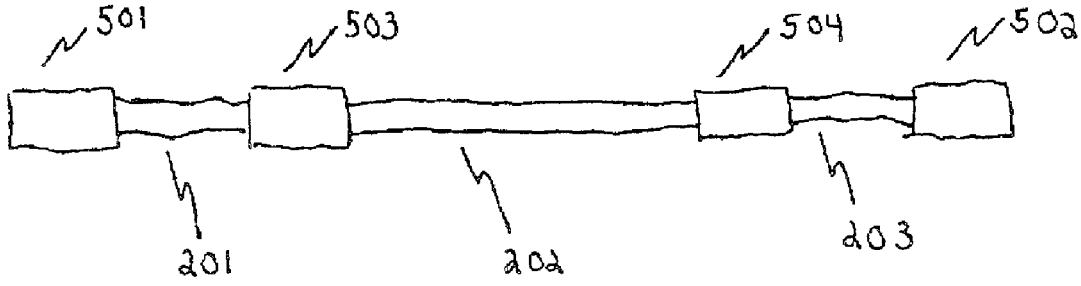
FIG. 5 is an embodiment of the invention with a plurality of pairs of grasping sections.

Note that the set of grasping sections that enable the hands to comfortably grasp the apparatus do not strictly need to be placed at the very ends of the apparatus so long as the separation between the hands when grasping a set of grasping sections is a desirable amount for a given class of exercises. Indeed, more than one set of grasping sections can be provided. This can be achieved by making multiple cylindrical cloth sections as described above and pulling them over the extensible section and securing each one to the extensible section in a different desired position along the length of the extensible section. Alternatively, grasping sections can be implemented as connecting sections to connect a series of extensible sections as shown in FIG. 5 for two pairs of grasping sections. Grasping sections 501 and 502 form a first pair and grasping sections 503 and 504 form the second pair. The sections 201, 202, and 203 are the extensible sections. Clearly, each extensible section can be made to exhibit a different extended length and exhibit a different degree of elasticity. Preferably, sections 201 and 203, for reasons of symmetry, exhibit substantially equal extended lengths and elasticity.

Each set of grasping sections can be a different distance apart to facilitate use of the apparatus for different exercises requiring different amounts of separation of the hands. Also, sets of grasping sections can be provided to accommodate persons with different shoulder spans. Also, each grasping section in a pair can be made sufficiently wide to enable a user to grasp the grasping section at a different place along the width of the grasping section. This would enable the user to make adjustments to the distance between hands while still providing the user a comfortable and therapeutic grasp.

The grasping section is preferably made of cloth, leather, suede or other material that exhibits softness and is not antagonistic to skin. Also, a grasping section may be formed of cloth or other suitable material enclosing foam rubber or other compressible material to increase the level of comfort to the user.

Although the present invention and its advantages have been described in detail, it should be understood that various changes, substitutions and alterations can be made herein without departing from the spirit and scope of the invention as defined by the appended claims. The invention achieves multiple objectives and because the invention can be used in different applications for different purposes, not every embodiment falling within the scope of the attached claims will achieve every objective. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A method for making an exercise apparatus, comprising the steps of:

providing plural strands, each strand being cut along a bias of a bolt of cloth;

interweaving the strands to form at least one extensible, but substantially inelastic, section, the extensible section having an un-extended length;

providing a pair of grasping sections to enable the apparatus to be grasped by both hands;

stretching the extensible section to an extended length, the difference between the extended length and the un-extended length does not exceed a fixed predetermined percentage of the un-extended length of the apparatus.

2. The method of claim 1, wherein the predetermined percentage is about 10%.

3. The method of claim 1, wherein the predetermined percentage is about 5%.

4. The method of claim 1, wherein the predetermined percentage is 1%.

5. The method of claim 1, wherein the apparatus may be stretched to the extended length by a person of ordinary strength.

6. The method of claim 1, further comprising the step of providing one or more connecting sections for connecting two or more extensible sections.

* * * * *